US006710784B1

(12) United States Patent
Piazza

(10) Patent No.: US 6,710,784 B1
(45) Date of Patent: Mar. 23, 2004

(54) METHOD AND APPARATUS FOR PERFORMING A VERTICAL SCALE FILTER FUNCTION IN A GRAPHICS DEVICE USING A SINGLE LINE BUFFER

(75) Inventor: Thomas A. Piazza, Granite Bay, CA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/470,101

(22) Filed: Dec. 21, 1999

(51) Int. Cl.[7] ..... G09G 5/00
(52) U.S. Cl. ..... 345/660
(58) Field of Search ..... 345/660, 560; 463/9

(56) References Cited

U.S. PATENT DOCUMENTS 5,764,238 A * 6/1998 Lum et al. ..... 345/439

* cited by examiner

*Primary Examiner*—Mark Zimmerman
*Assistant Examiner*—Scott Wallace
(74) *Attorney, Agent, or Firm*—Calvin E. Wells

(57) ABSTRACT

An embodiment of a graphics device that performs a vertical scale filter function using a single line buffer is disclosed. The graphics device includes a line buffer and a vertical scale filter function unit that produces an output of blended data. The line buffer stores the output of blended data and the vertical scale filter uses a next line of display data and a line of blended data stored in the line buffer to produce the output of blended data.

10 Claims, 5 Drawing Sheets

Figure 1 – Prior Art

METHOD AND APPARATUS FOR PERFORMING A VERTICAL SCALE FILTER FUNCTION IN A GRAPHICS DEVICE USING A SINGLE LINE BUFFER

FIELD OF THE INVENTION

The present invention pertains to the field of computer systems. More particularly, this invention pertains to the field of performing a vertical scale filter function in a graphics device.

BACKGROUND OF THE INVENTION

A key requirement for a graphics controller is the ability to take a display stream that represents pixels on a display monitor and scale that display stream to any arbitrary size. An example use of this feature is video conferencing, where the display stream represents perhaps a display of 320 pixels across by 240 lines high and a full screen display of 1024 pixels across by 768 lines high is desired.

One technique that can be employed to perform the scale function involves simply replicating pixels and lines. For example, if a vertical scale factor of three is desired, each line of the display stream can be replicated three times and subsequently displayed as three sequential lines. This technique has the drawback of producing a "blocky" display with a significant deterioration of display quality.

An additional technique that can be employed to perform the scale function is bilinear interpolation. For a vertical scale function, values are interpolated between two lines to generate smooth data values between the two lines. This technique typically produces a display with a much less significant deterioration of display quality as compared to the replication technique discussed above.

A primary drawback to prior bilinear interpolation vertical scale filter implementations is the associated hardware costs. The graphics display subsystem must simultaneously access pixels from two adjacent source data lines from which it generates vertically smoothed output values. Prior implementations include two independent line buffers, one for each of the two adjacent source data lines. For an input stream of 720 pixels across at 16 bits per pixel, each line buffer would need to include 1440 bytes of storage.

FIG. 1 is a block diagram of an example prior implementation of a vertical scale function. A vertical scale filter 130 receives input from a line buffer 110 and a line buffer 120. The line buffers 110 and 120 store display line data received from a graphics memory 150. The vertical scale filter 130 takes the display line data stored in the line buffers 110 and 120 and interpolates values between the display line data stored in the line buffers to produce vertically smoothed output values. These output values are delivered to a display function 140.

BRIEF DESCRIPTION OF THE DRAWINGS

The invention will be understood more fully from the detailed description given below and from the accompanying drawings of embodiments of the invention which, however, should not be taken to limit the invention to the specific embodiments described, but are for explanation and understanding only.

DETAILED DESCRIPTION

Figure 1:
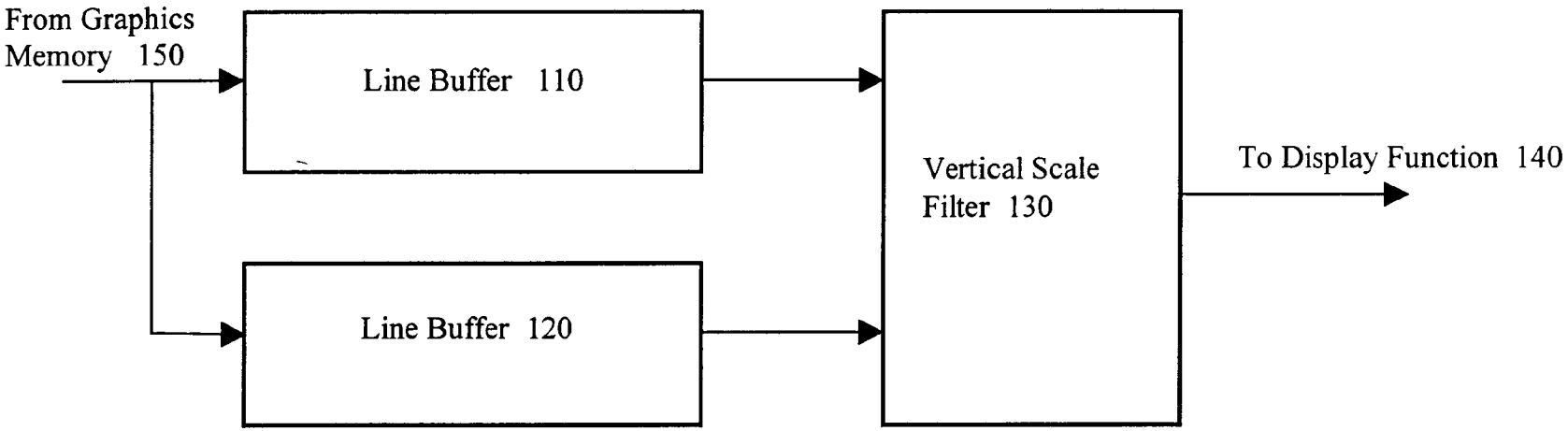
FIG. 1 is a block diagram of a prior implementation of a vertical scale function.
Figure 2:
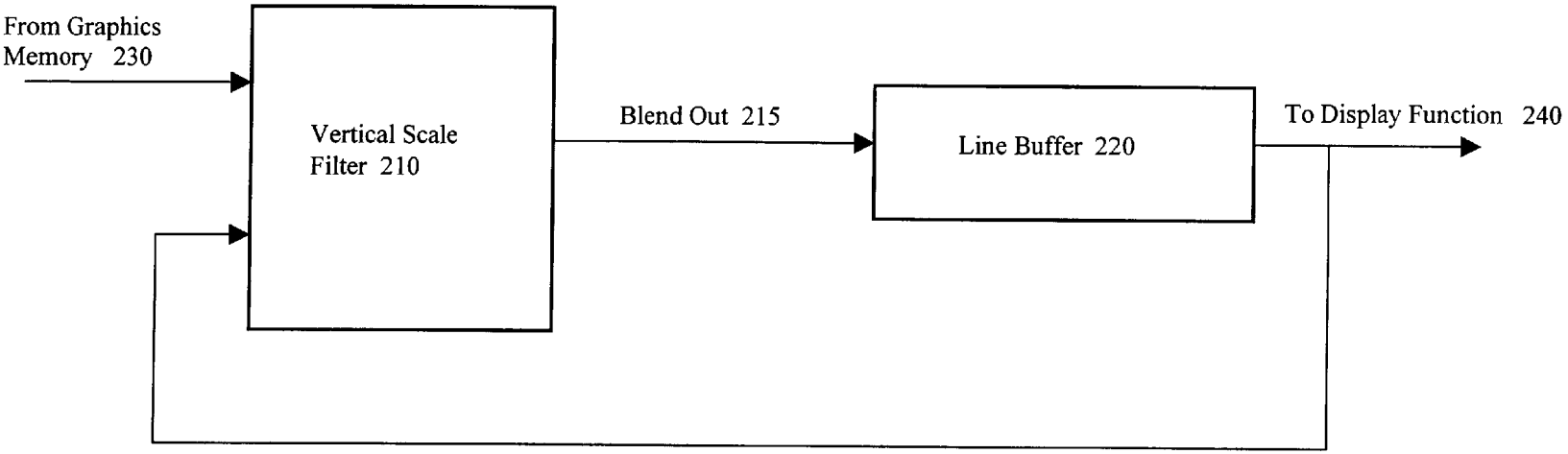
FIG. 2 is a block diagram of an example embodiment of a vertical scale function using a single line buffer.

FIG. 2 is a block diagram of an embodiment of a vertical scale function using bilinear interpolation implemented with a single line buffer 220. The line buffer 220 in this example embodiment is the same size as would be implemented with the prior two line buffer approach. To perform a bilinear blend with one line buffer, the values in that buffer must be interpolated at the input to that buffer. In this embodiment, the interpolation is performed by a vertical scale filter 210. The vertical scale filter 210 recursively uses the values in the line buffer 220 and combines them with source lines of display data received from a graphics memory 230. The vertical scale filter 210 delivers the results of the blend operation to the line buffer 220 via a blend out path 215. The data stored in the line buffer 220 is also delivered to a display function 240 for output to a display device.

An element of this embodiment is that the blended data stored in the line buffer 220 is reused. The data in the line buffer 220 is a composite (bilinear blend) of the data from the current source line received from the graphics memory 230, which is the closest source line below the current display line, and the closest source line above the current display line.

The present embodiment implements a vertical scale function, discussed below, to uncorrupt the stale data in the line buffer 220 while combining the uncorrupted data with source line data received from the graphics memory 230. The vertical scale function is performed by the vertical scale filter 210. The vertical scale filter 210 includes an accumulator and other hardware to perform the vertical scale function (not shown in FIG. 2, but see FIG. 3 and accompanying discussion). The accumulator starts at zero and increments by the inverse of a scale factor every time a line of display data is delivered to the display function 240. For example, if the scale factor is 3, the accumulator increments by 0.3333. Over a seven line interval, the accumulator would transition through the following:

Line 0: Accumulator=0.0000

Line 1: Accumulator=0.3333

Line 2: Accumulator=0.6666

Line 3: Accumulator=1.0000

Line 4: Accumulator=1.3333

Line 5: Accumulator=1.6666

Line 6: Accumulator=2.0000

In order to describe the vertical scale function of the present embodiment, a few terms must be defined as follows:

Fraction[n]: Accumulator's fractional part for the present output line

Fraction[n−1]: Accumulator's fractional part for the previous output line

Integer: Accumulator's integer part for the present output line

Buffer: Present contents of line buffer 220.

Source: Array of source line data delivered to the vertical scale filter 210 from the graphics memory 230.

Alpha: If Fraction[n] is not equal to 0, then Alpha is defined as (1−Fraction[n]/(1−Fraction[n−1]). If Fraction[n] equals 0, then Alpha is defined as 0.

The vertical scale function performed by the vertical scale filter 210 is performed as follows. If Fraction[n] is not equal to 0, then a present output line is produced according to the equation Buffer[n−1]*Alpha+Source[Integer+1]*(1−Alpha). If Fraction[n] is 0, then the present output line is produced as Source[Integer].

The tables below show examples for vertical scale factors of 3 and 7 and step through several output display lines. The table headings are defined as follows:

| | |
|---|---|
| Display Line: | Present line output to the display function 240 |
| Accum: | Accumulator's value |

-continued

| | |
|---|---|
| Alpha: | Alpha term as defined above |
| 1 - Alpha: | 1 minus the present Alpha |
| Top Line: | Closest source line above the present display line (integer value of the accumulator) |
| Bottom Line: | Closest source line below the present display line (integer value of the Accumulator plus one) |
| Out of Buffer: | The % of the top and bottom lines after the prior contents of the line buffer are multiplied by the Alpha term. |
| Blend Out: | The % of the top and bottom lines included in the blended display line data after the entire vertical scale function is applied to the prior contents of the line buffer 220 and the source data from the graphics memory 230. The blended display line data is delivered to the line buffer 220 and the display function 240. |

The following table demonstrates an example of a vertical scale function using a single line buffer as described above with a scale factor of three.

| Display | | | 1- | Top | Bottom | Out of Buffer | | Blend Out | |
|---|---|---|---|---|---|---|---|---|---|
| Line | Accum | Alpha | Alpha | Line | Line | % Top | % Bottom | % Top | % Bottom |
| 0 | 0.0000 | 0.0000 | 1.0000 | 0 | 0 | 0.0000 | 0.0000 | 1.0000 | 0.0000 |
| 1 | 0.3333 | 0.6667 | 0.3333 | 0 | 1 | 0.6667 | 0.0000 | 0.6667 | 0.3333 |
| 2 | 0.6667 | 0.5000 | 0.5000 | 0 | 1 | 0.3333 | 0.1667 | 0.3333 | 0.6667 |
| 3 | 1.0000 | 0.0000 | 1.0000 | 1 | 2 | 0.0000 | 0.0000 | 1.0000 | 0.0000 |
| 4 | 1.3333 | 0.6667 | 0.3333 | 1 | 2 | 0.6667 | 0.0000 | 0.6667 | 0.3333 |
| 5 | 1.6667 | 0.5000 | 0.5000 | 1 | 2 | 0.3333 | 0.1667 | 0.3333 | 0.6667 |
| 6 | 2.0000 | 0.0000 | 1.0000 | 2 | 3 | 0.0000 | 0.0000 | 1.0000 | 0.0000 |

The following table demonstrates an example of a vertical scale function using a single line buffer as described above with a scale factor of seven.

| Display | | | 1- | Top | Bottom | Out of Buffer | | Blend Out | |
|---|---|---|---|---|---|---|---|---|---|
| Line | Accum | Alpha | Alpha | Line | Line | % Top | % Bottom | % Top | % Bottom |
| 0 | 0.0000 | 0.0000 | 1.0000 | 0 | 1 | 0.0000 | 0.0000 | 1.0000 | 0.0000 |
| 1 | 0.1429 | 0.8571 | 0.1429 | 0 | 1 | 0.8571 | 0.0000 | 0.8571 | 0.1429 |
| 2 | 0.2857 | 0.8333 | 0.1667 | 0 | 1 | 0.7143 | 0.1190 | 0.7143 | 0.2857 |
| 3 | 0.4286 | 0.8000 | 0.2000 | 0 | 1 | 0.5714 | 0.2286 | 0.5714 | 0.4286 |
| 4 | 0.5714 | 0.7500 | 0.2500 | 0 | 1 | 0.4286 | 0.3214 | 0.4286 | 0.5714 |
| 5 | 0.7143 | 0.6667 | 0.3333 | 0 | 1 | 0.2857 | 0.3571 | 0.2857 | 0.7143 |
| 6 | 0.8571 | 0.5000 | 0.5000 | 0 | 1 | 0.1429 | 0.3810 | 0.1429 | 0.8571 |
| 7 | 1.0000 | 0.0000 | 1.0000 | 1 | 2 | 0.0000 | 0.0000 | 1.0000 | 0.0000 |
| 8 | 1.1429 | 0.8571 | 0.1429 | 1 | 2 | 0.8571 | 0.0000 | 0.8571 | 0.1429 |
| 9 | 1.2857 | 0.8333 | 0.1667 | 1 | 2 | 0.7143 | 0.1190 | 0.7143 | 0.2857 |
| 10 | 1.4286 | 0.8000 | 0.2000 | 1 | 2 | 0.5714 | 0.2286 | 0.5714 | 0.4286 |
| 11 | 1.5714 | 0.7500 | 0.2500 | 1 | 2 | 0.4286 | 0.3214 | 0.4286 | 0.5714 |
| 12 | 1.7143 | 0.6667 | 0.3333 | 1 | 2 | 0.2857 | 0.3571 | 0.2857 | 0.7143 |
| 13 | 1.8571 | 0.5000 | 0.5000 | 1 | 2 | 0.1429 | 0.3810 | 0.1429 | 0.8571 |
| 14 | 2.0000 | 0.0000 | 1.0000 | 2 | 3 | 0.0000 | 0.0000 | 1.0000 | 0.0000 |

A special case may occur when the integer part of the accumulator changes and the fractional part is non-zero. This may occur when the scale factor is non-integer. Under this condition the Alpha term may be forced to zero and the line buffer 220 may be updated. The vertical scale filter 210 may make a second pass to resolve the line buffer 220 with the correct interpolated values.

Figure 3:
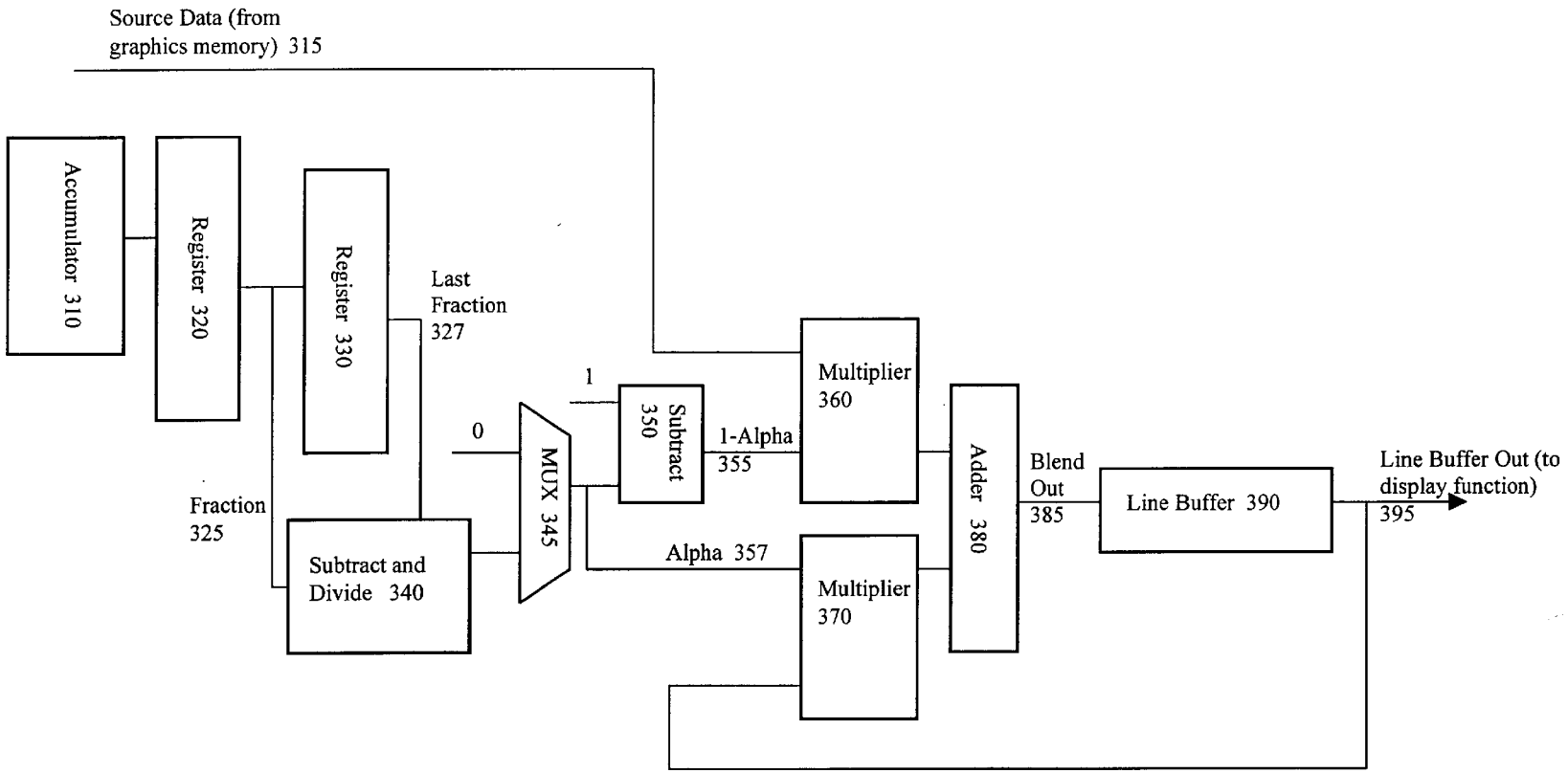
FIG. 3 is a block diagram of an additional example embodiment of a vertical scale function using a single line buffer.

FIG. 3 is a block diagram of one hardware embodiment of the vertical scale function discussed above in connection with FIG. 2. This hardware embodiment may be located in the vertical scale filter 210 of FIG. 2. An accumulator 310 increments by the inverse of a selected scale factor every display line time. The accumulator 310 value is stored in a register 320, and is clocked in to an additional register 330 one display line time later. Register 320 therefore contains a current accumulator value while register 330 contains the previous accumulator value. The fractional part of the current accumulator value is output to a subtract and divide circuit 340. The output of the fractional part of the current accumulator value to the subtract and divide circuit 340 is represented by the fraction path 325. The fractional part of the previous accumulator value is also output to the subtract and divide circuit 340. The output of the fractional part of the previous accumulator value to the subtract and divide circuit 340 in represented by the last fraction path 327.

The subtract and divide circuit 340 produces an output according to the equation Out=(1−Fraction)/(1−Last Fraction). This output is delivered to a multiplexor (MUX) 345. If the fractional part of the current accumulator value (Fraction) is non-zero, then the MUX 345 delivers the output of the subtract and divide circuit 340 to both a subtract circuit 350 and a multiplier 370. If the fractional part of the current accumulator value is zero, then the MUX 345 outputs a zero to the subtract circuit 350 and the multiplier 370. The output of the MUX 345 corresponds to the Alpha term defined above and is represented in FIG. 3 as the path Alpha 357.

The subtract circuit 350 subtracts the output of the MUX 345 from 1 to produce the term 1−Alpha as represented by the 1−Alpha path 355 in FIG. 3. The output of the subtract circuit 350 is delivered to a multiplier 360.

The multiplier 360 receives at its inputs a line of source data 315 from a graphics memory (not shown) and the 1−Alpha term from the subtract circuit 350. The multiplier 360 multiplies the source data by the 1−Alpha term and delivers the results to an adder 380. The multiplier 370 multiplies the data stored in a line buffer 390 by the Alpha term and delivers the results to the adder circuit 380. The adder circuit 380 adds the outputs of the multipliers 360 and 370 to produce a blend out 385 that is delivered to the line buffer 390. The contents of the line buffer 390 are then delivered to a display function (not shown) via a line buffer out path 395.

Once the line buffer data is delivered to the display function, the accumulator increments by the inverse of the scale factor and the above procedure repeats.

Figure 4:
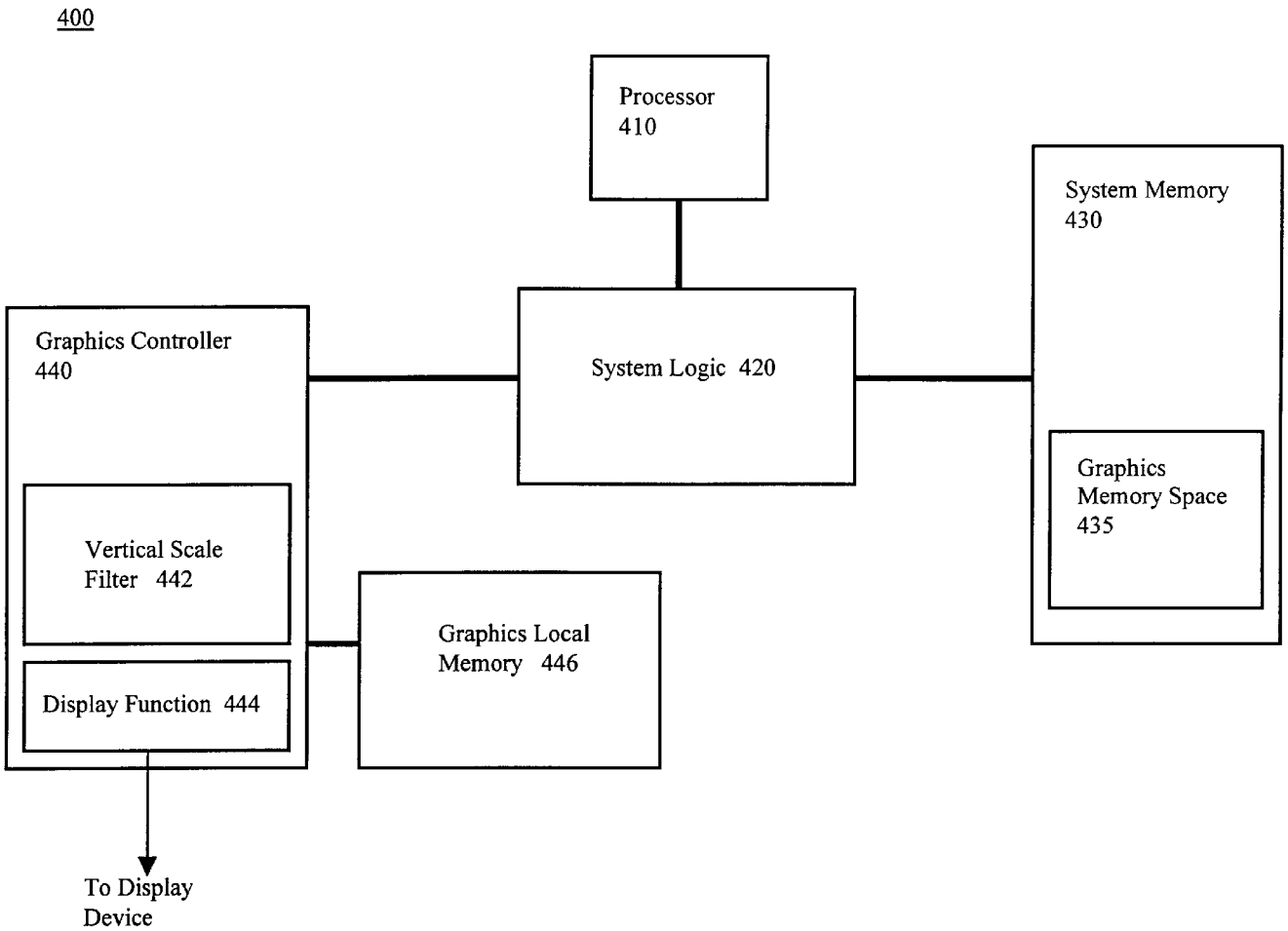
FIG. 4 is a block diagram of a system including a graphics controller implemented in accordance with an embodiment of the invention.

FIG. 4 is a block diagram of a computer system 400 including a graphics controller 440 that implements a vertical scale filter 442. The system 400 includes a processor 410, a system logic device 420, and a system memory 430. The system memory 430 includes a graphics memory space 435.

The graphics controller 440 includes the vertical scale filter 442, a display function 444, and also includes an interface to a graphics local memory device 446. The vertical scale filter 442 is meant to represent one of the embodiments discussed above in connection with FIGS. 2 and 3. The vertical scale filter 442 receives as one of its inputs a line of display data from a graphics memory, as discussed above in connection with FIGS. 2 and 3. This graphics memory may include either the graphics local memory device 446 or the graphics memory space 435 in system memory 430. The vertical scale filter 442 delivers its output to the display function 444.

Figure 5:
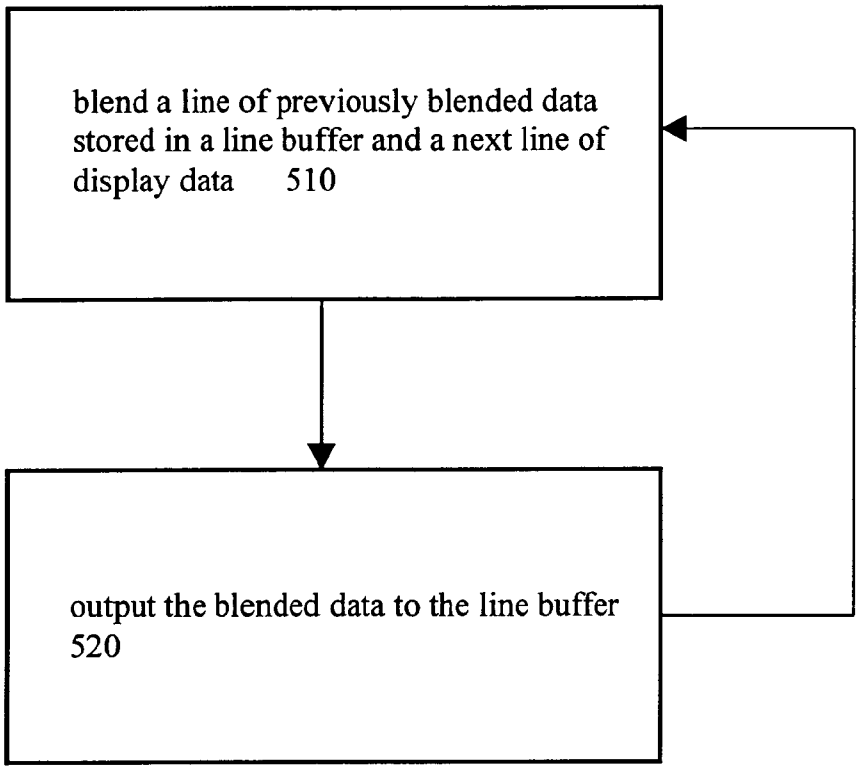
FIG. 5 is a flow diagram of one embodiment of a method for performing a vertical scale function using a single line buffer.

FIG. 5 is a flow diagram of one embodiment of a method for performing a vertical scale function using a single line buffer. At step 510, a line of previously blended data stored in a line buffer is blended with a next line of display data. The blending operation of step 510 may be implemented using the techniques described above in connection with FIGS. 2 and 3, although other techniques are possible. The output of the blending operation of step 510 is output to the line buffer at step 520. The process repeats for additional display lines.

In the foregoing specification the invention has been described with reference to specific exemplary embodiments thereof. It will, however, be evident that various modifications and changes may be made thereto without departing from the broader spirit and scope of the invention as set forth in the appended claims. The specification and drawings are, accordingly, to be regarded in an illustrative rather than in a restrictive sense.

What is claimed is:

1. A graphics device, comprising:

a line buffer; and a vertical scale filter function unit to produce an output of blended data, the line buffer to store the output of blended data, the vertical scale filter to use only a next line of display data and a line of blended data stored in the line buffer to produce the output of blended data, wherein the line of blended data stored in the line buffer is a combination of a previous line of display data and the next line of display data, wherein the vertical scale filter function includes an accumulator that increments by the inverse of a scale factor and outputs a fractional part every output line time.

2. The graphics device of claim 1, wherein the vertical scale filter function includes a first register to store a current fraction output by the accumulator and a second register to store a previous fraction output by the accumulator.

3. The graphics device of claim 2, wherein the vertical scale filter function includes a subtract and divide circuit coupled to receive the current fraction from the first register and further coupled to receive the previous fraction from the second register, the subtract and divide circuit to output a value according to the equation (1−current fraction)/(1−previous fraction).

4. The graphics device of claim 3, wherein the vertical scale filter function includes a subtract circuit coupled to receive the output of the subtract and divide circuit, the subtract circuit to output a value according to the equation (1−output of subtract and divide circuit).

5. The graphics device of claim 4, wherein the vertical scale filter function includes a first multiplier circuit, a second multiplier circuit, and an adder circuit, the first multiplier circuit coupled to receive the output of the subtract circuit and further coupled to receive the next line of display data, the first multiplier circuit to multiply the output of the subtract circuit and the next line of display data and the first multiplier circuit to output a result to the adder, the second multiplier circuit coupled to receive the output of the subtract and divide circuit and further coupled to receive the line of blended data stored in the line buffer, the second multiplier circuit to multiply the output of the subtract and divide circuit and the line of blended data stored in the line buffer to output a result to the adder, the adder to add the results from the first and second multiplier circuits to produce the output of blended data, the line buffer to store the output of blended data.

6. A method for performing a vertical scale filter function, comprising:

blending only a line of previously blended data stored in a line buffer and a next line of display data, wherein blending a line of previously blended data and a next line of display data includes blending a line that is a combination of a previous line of display data and the next line of display data with the next line of display data;

outputting the blended data to the line buffer;

incrementing an accumulator by the inverse of a scale factor; and outputting a fractional part of the incremented accumulated value every output line time.

7. The method of claim 6, further comprising:

storing a current fraction output by the accumulator in a first register; and storing a previous fraction output by the accumulator in a second register.

8. The method of claim 7, further comprising performing a subtract and divide calculation according to the equation (1−current fraction)/(1−previous fraction).

9. The method of claim 8, further comprising performing a subtract calculation according to the equation (1−result of subtract and divide calculation).

10. The method of claim 9, further comprising:

performing a first multiply operation to multiply the result of the subtract operation and the next line of display data;

performing a second multiply operation to multiply the result of the subtract and divide calculation and the line of blended data stored in the line buffer;

adding the results of the first and second multiply operations to produce the output of blended data; and storing the output of blended data in the line buffer.

* * * * *